US008656709B2

(12) United States Patent
Phillips, Jr. et al.

(10) Patent No.: US 8,656,709 B2
(45) Date of Patent: Feb. 25, 2014

(54) DUAL-LAYER TO FLANGE WELDED JOINT

(75) Inventors: Robert Arthur Phillips, Jr., Stockbridge, MI (US); Michael Paul Schmidt, Howell, MI (US)

(73) Assignee: Flexible Metal, Inc., Hamburg, MI (US)

( * ) Notice: Subject to any disclaimer, the term of this patent is extended or adjusted under 35 U.S.C. 154(b) by 572 days.

(21) Appl. No.: 12/319,987

(22) Filed: Jan. 14, 2009

(65) Prior Publication Data

US 2009/0188247 A1 Jul. 30, 2009

Related U.S. Application Data

(60) Provisional application No. 61/011,029, filed on Jan. 14, 2008.

(51) Int. Cl.
*F02B 27/02* (2006.01)
*F01N 1/00* (2006.01)

(52) U.S. Cl.
USPC ..... 60/313; 60/323; 60/324

(58) Field of Classification Search
USPC ..... 60/313, 322–324
See application file for complete search history.

(56) References Cited

U.S. PATENT DOCUMENTS

| | | | | |
|---|---|---|---|---|
| 3,468,560 | A | 9/1969 | Cassel | |
| 5,293,743 | A * | 3/1994 | Usleman et al. | 60/299 |
| 5,349,817 | A | 9/1994 | Bekkering | |
| 5,419,127 | A * | 5/1995 | Moore, III | 60/322 |
| 5,761,905 | A * | 6/1998 | Yamada et al. | 60/323 |
| 6,082,104 | A * | 7/2000 | Hyakutake et al. | 60/323 |
| 6,427,440 | B1 * | 8/2002 | Bonny et al. | 60/323 |
| 6,604,358 | B2 * | 8/2003 | Durr et al. | 60/323 |
| 8,104,273 | B2 * | 1/2012 | Barrieu et al. | 60/323 |
| 2007/0180820 | A1 | 8/2007 | Kenyon et al. | |

OTHER PUBLICATIONS

Int'l Search Report, Mar. 12, 2009, Metaldyne Company LLC.

* cited by examiner

*Primary Examiner* — Thomas Denion
*Assistant Examiner* — Diem Tran
(74) *Attorney, Agent, or Firm* — McDonald Hopkins LLC

(57) ABSTRACT

The present invention provides dual-layer to flange weld joint for an exhaust manifold assembly. The manifold includes an inner assembly connected to a flange, and an outer shell spaced apart from the inner assembly to allow for an air gap between the shell and the inner assembly. The outer shell further includes a gap between the end portion of the outer shell and the flange. This gap allows a single exterior weld joint to connect the inner assembly and outer shell to the flange.

9 Claims, 4 Drawing Sheets

DUAL-LAYER TO FLANGE WELDED JOINT

RELATED APPLICATIONS

This non-provisional application claims the benefit of U.S. Provisional Patent Application No. 61/011,029, entitled "DUAL-LAYER TO FLANGE WELDED JOINT" filed Jan. 14, 2007, which is hereby incorporated by reference in its entirety.

FIELD OF ART

The present invention relates generally to dual-layer to flange welded joints, and more specifically, to dual-layer to flange welded joints for use in exhaust manifolds for internal combustion engines.

BACKGROUND OF THE INVENTION

Dual-layer to flange welded joints are used in a variety of applications, including heat transfer applications. For example, air gap-insulated double-walled exhaust manifolds have been increasingly used in exhaust systems of motor vehicles. Together with other air gap-insulated double-walled exhaust pipes, they provide for the optimal operation of emission control devices, such as catalytic converters, positioned downstream. Further, they increase the durability of the exhaust manifold and reduce noise, vibration and harshness.

Air gap-insulated, double-walled exhaust manifolds also reduce the amount of heat released from the exhaust gas to the environment, so that the exhaust gas flows to the emission control device at a higher temperature than in single-walled exhaust manifolds and exhaust pipes. This is significant especially during the warm-up phase of the internal combustion engine, because the catalyst will thus rapidly reach its working temperature. In addition, the air gap insulates the outer wall from the inner wall, thereby minimizing discoloration and excessive heating of the outer wall. This is becoming more important as turbo charging, direct injection, Homogeneous Charge Compression Ignition, and other technologies produce higher temperatures, pressures, and loads on exhaust systems.

Prior-art dual-walled exhaust manifolds have an outer wall and a one-part or multipart inner wall, which may be shaped parts made of sheet metal in a half-shell design. During assembly of the manifold, the inner and outer walls are connected to an exit flange. Currently, such connections require both external and internal welds. Therefore, such a manufacturing process is expensive and can lead to several problems.

For example, internal welds are difficult to perform and inspect, increasing the likelihood of weld failure as well as labor costs. Deficiencies in these welds can lead to decreased durability, improper insulation, wall warping and deformation, decreased emissions performance, discoloration, as well as increased noise and vibration. In addition, while techniques such as TIG and Plasma welding help avoid weld spattering and wall warping or deformation, these techniques are expensive, and still require labor and inspection.

Accordingly, manufacturing costs of a manifold assembly can be significant, and a continual need exists in the industry to reduce these costs. Reducing the number of welds in a manifold assembly can significantly reduce such costs. In addition, the placement and type of the welds impact the design options as well as the overall strength and durability of the manifold assembly.

Therefore, there is a need in the art to provide a dual-layer to flange welded joint that can overcome at least several of the above disadvantages and achieve at least some of the above advances desirable in the art.

SUMMARY OF INVENTION

A dual wall exhaust manifold assembly with a flange weld joint is provided. The manifold has an outer shell spaced apart from an inner assembly to allow for an air gap between the shell and the inner assembly. The inner assembly, with runners for transporting engine exhaust from an inlet to an outlet, is connected to a flange. The outer shell includes a gap between the end portion of the outer shell and the flange. This gap allows a single exterior weld joint to connect the inner assembly and outer shell to the flange.

DESCRIPTION OF THE DRAWINGS

Objects and advantages together with the operation of the invention may be better understood by reference to the following detailed description taken in connection with the following illustrations, wherein.

DETAILED DESCRIPTION OF THE INVENTION

While the invention is described with reference to manifold assemblies, it should be clear that the invention should not be limited to such uses or embodiments. The description herein is merely illustrative of an embodiment of the invention and in no way should limit the scope of the invention.

Figure 1:
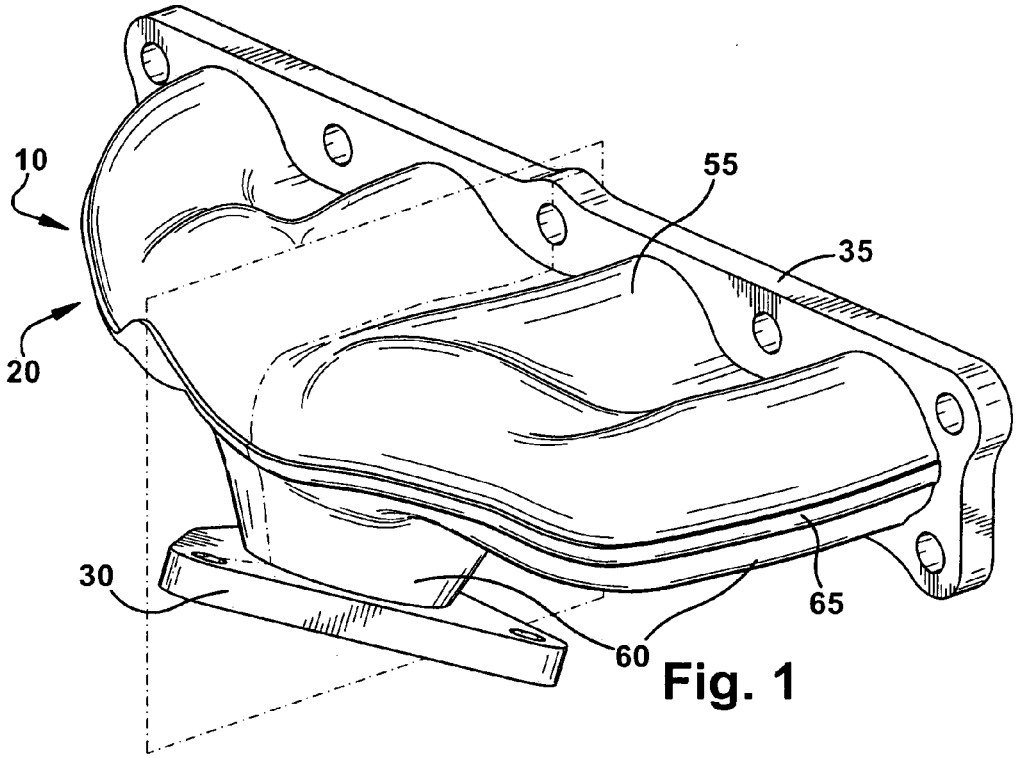
FIG. 1 is a rear perspective view of a manifold assembly in an embodiment of the present invention.
Figure 2:
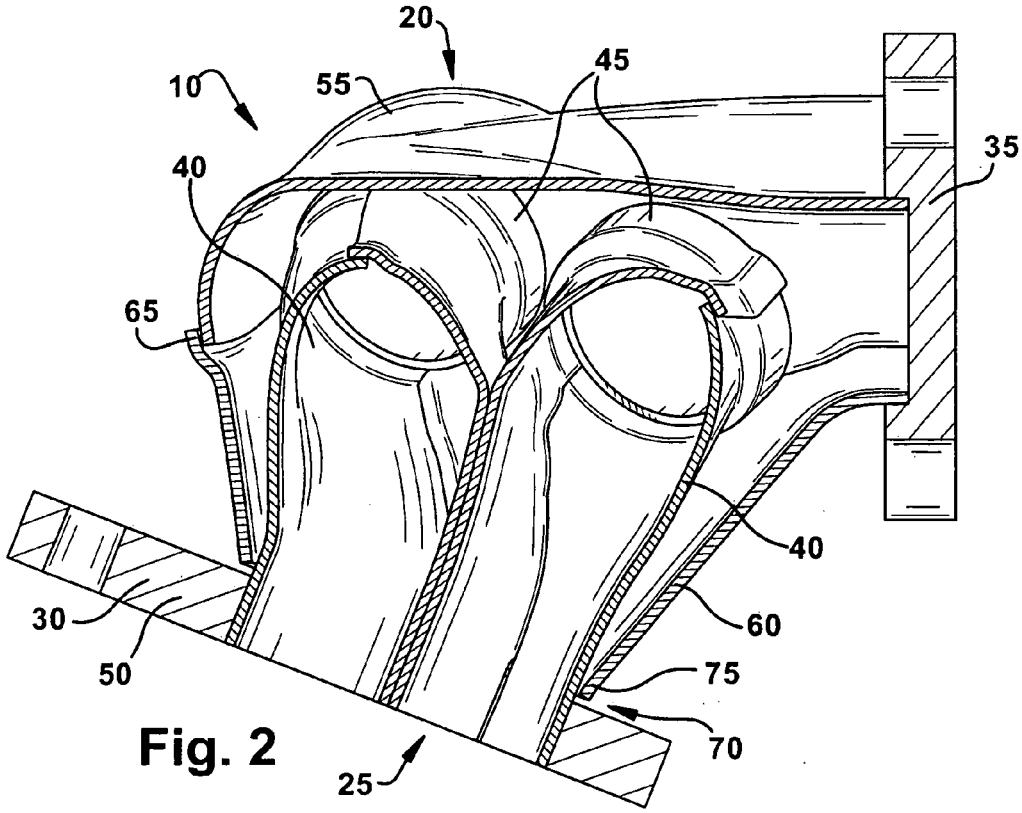
FIG. 2 illustrates a partial cross-sectional view of an outer shell and an inner assembly of a manifold assembly in an embodiment of the present invention.
Figure 5:
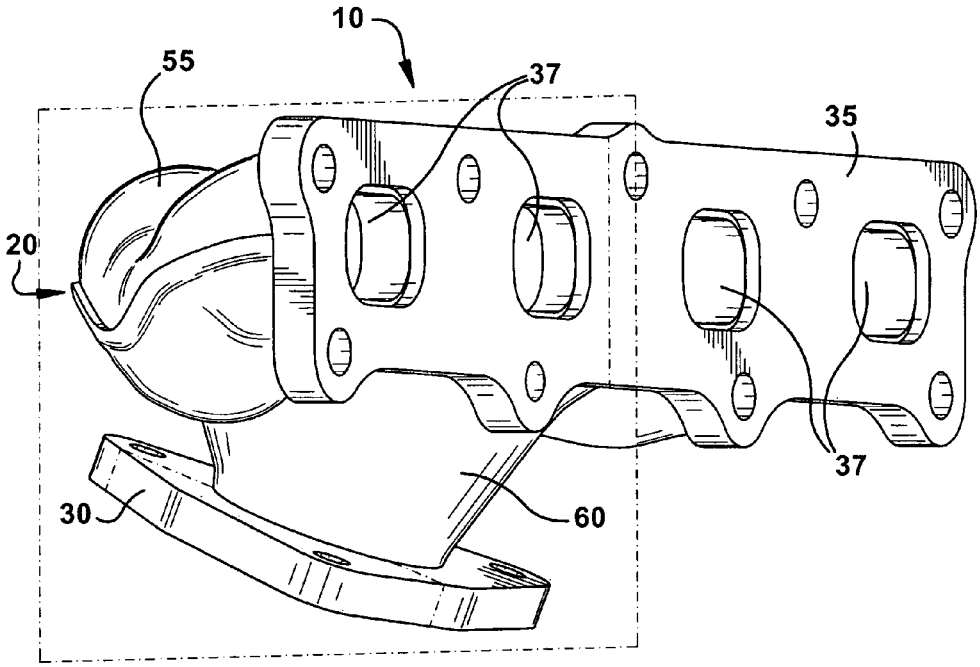
FIG. 5 is a front perspective view of a manifold assembly in an embodiment of the present invention.

A dual-walled exhaust manifold assembly 10 having a dual-layer to flange welded joint 15 formed with a single external weld 80 is provided. As shown in FIGS. 1 and 2, the manifold assembly 10 generally includes an outer shell 20 and an inner assembly 25 connected to an outlet flange 30 and an inlet flange 35. As shown in FIGS. 2 and 5, the inner assembly 25 is in fluid communication with each of several openings 37 in the inlet flange 35. The inlet flange 35 is attachable to an engine block (not shown) so that exhaust from a vehicle engine flows from the engine through the inner assembly 25 via the openings 37. The engine exhaust is expelled from the inner assembly 25 through the outlet flange 30. It is to be understood that the manifold 10 can have any number of openings 37 for any number of cylinders of an engine.

As best shown in FIG. 2, the inner assembly 25 may comprise one or more runners 40 in fluid communication with the openings 37 of the inlet flange 35. The exhaust manifold 10 may have any number of runners 40 for any number of cylinders of an engine. For example, the manifold 10 can be used in a V-8 engine where the manifold 10 may be duplicated on the opposite side of the engine. Exhaust from a vehicle engine may flow from the engine through passageways into the inlet flange 35 and in the runners 40. The engine exhaust is expelled from the manifold 10 through the outlet flange 30.

It is to be understood that the runners 40 may be secured directly to the inlet flange 35, or to one or more tubes 45 extending from the openings 37 (as shown in FIG. 2). One of ordinary skill in the art will appreciate that a variety of configurations may be used to connect the inner assembly 25 to the openings 37. The opposite end of the inner assembly 25 is capable of being positioned in a bore 50 of the outlet flange 30. As best shown in FIG. 2, the inner assembly 25 may be sized for a slip fit connection in the bore 50. The slip fit connection allows for thermal expansion of the inner assembly within the bore.

Figure 4:
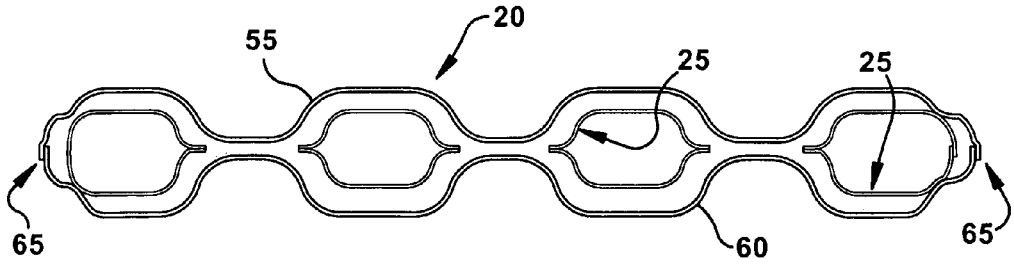
FIG. 4 is a cross-sectional view of a manifold assembly in an embodiment of the present invention.

As shown in FIG. 4, the outer shell 20 and the inner assembly 25 are spaced apart from each other a predetermined amount to form an air gap therebetween. The air gap insulates the inner assembly 25 from conducting or otherwise transferring excessive heat to the outer shell 20. The amount of space between the outer shell 20 and inner assembly 25 may be based upon the specifications of the engine or components of the manifold assembly 10.

The outer shell 20 and the inner assembly 25 may be formed from two or more components. For example, the outer shell may be formed from an upper portion 55 and a lower portion 60. The upper and lower portions 55, 60 are positioned to form a joint 65 that may be welded together, crimped together, or connected by any other manner known in the art. It is also anticipated that outer shell 20 and inner assembly 25 may be integrally formed. In a preferred embodiment, the outer shell 20 substantially surrounds and/or encloses the inner shell 25. The outer shell 20 may have several channels corresponding in number and shape to the runners 40 of the inner shell 25. As shown in FIGS. 1 and 2, the lower portion 60 surrounds the lower part of the inner assembly 25 and extends toward the outlet flange 30. A gap 70 is provided between an end 75 of the lower portion 60 and the outlet flange 30.

Figure 3:
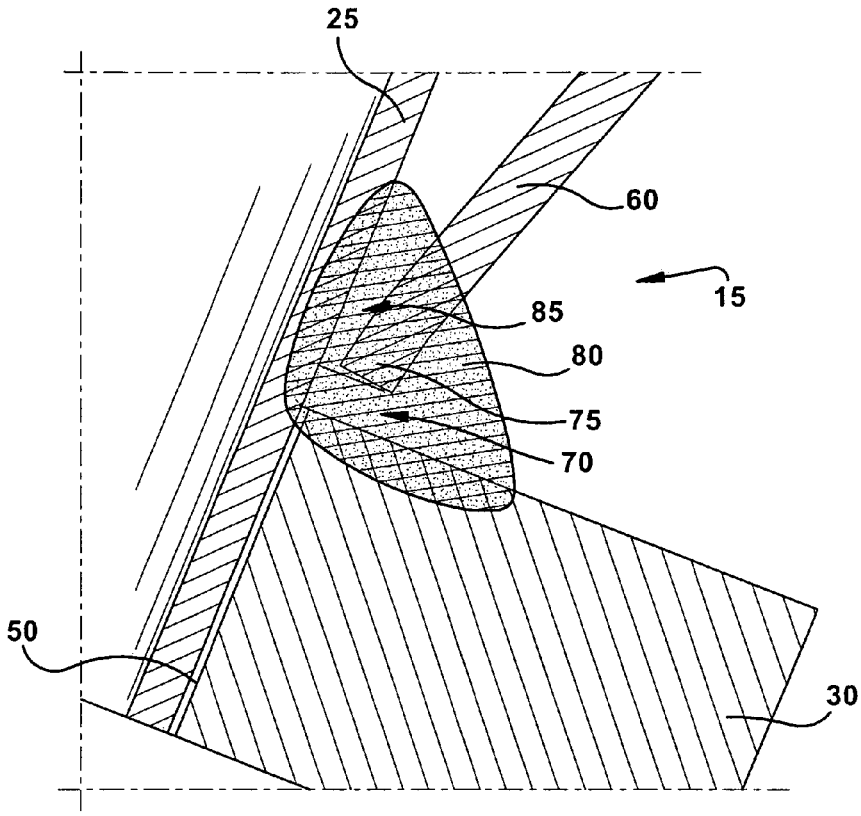
FIG. 3 is a partial cross-sectional view of a dual-layer to flange welded joint in an embodiment of the present invention.

As best shown in FIG. 3, the gap 70 allows both the inner assembly 25 and the lower portion 60 to be externally welded to the outlet flange 30 with a single weld 80 to form the dual-layer to flange welded joint 15. It is to be understood that the gap 70 as well as the single weld 80 may extend around the entire perimeter of the lower portion 60. It is also to be understood that any type of welding process or material may be used to form the single weld 80 of the dual-layer to flange welded joint 15. In addition, as shown in FIG. 3, a space 85 may also be provided between the end 75 and the inner assembly 25 to allow the single weld 80 to extend therebetween, resulting in a stronger connection.

Figure 6:
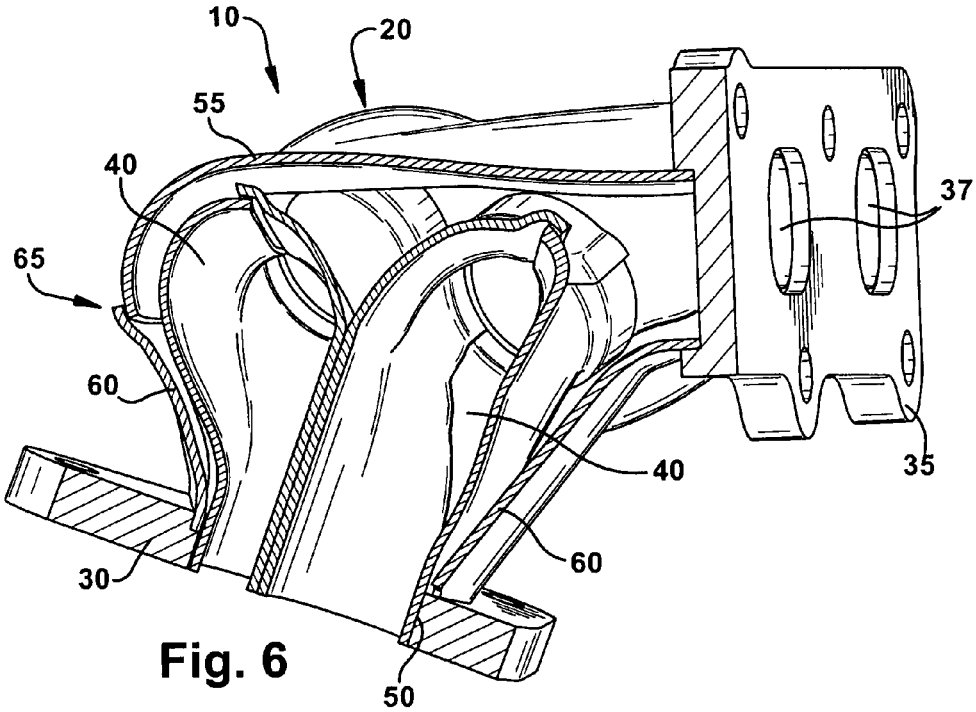
FIG. 6 is a cross-sectional view of a manifold assembly in an embodiment of the present invention.
Figure 7:
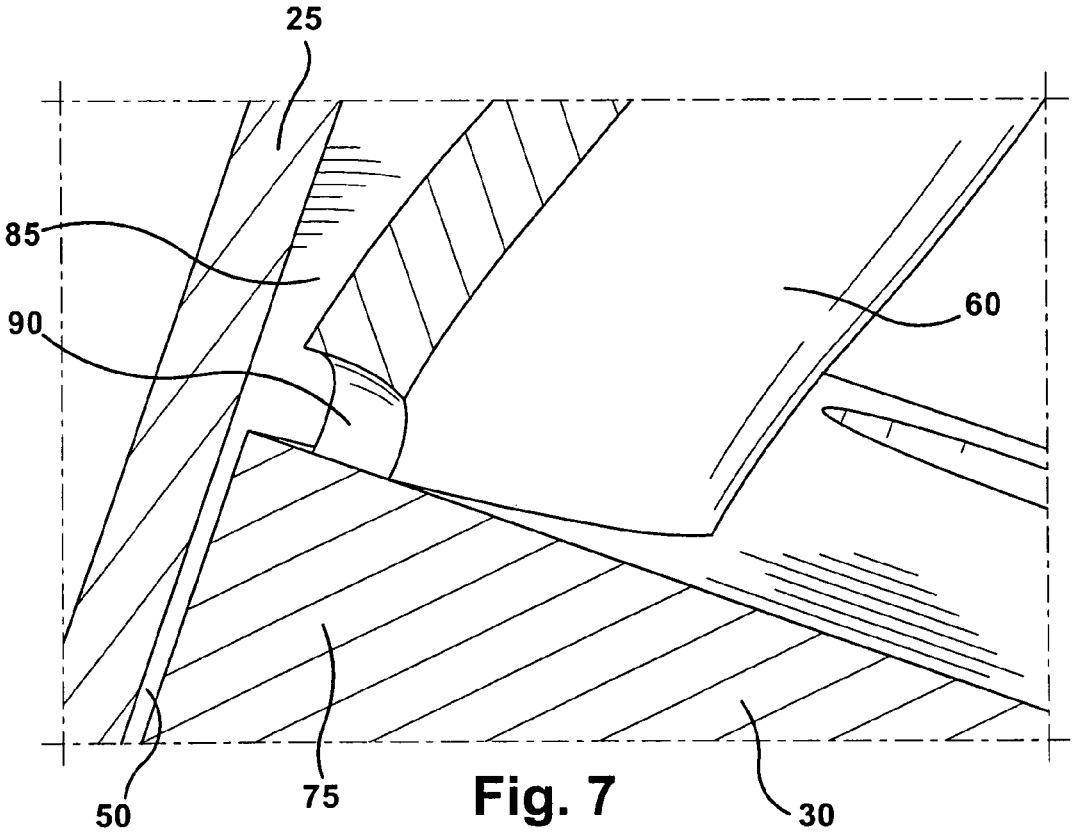
FIG. 7 is a partial cross-sectional view of a dual-layer to flange welded joint in an embodiment of the present invention.

In an embodiment, as shown in FIGS. 5, 6, and 7, the end 75 of the lower portion 60 may be positioned adjacent the outlet flange 30. As best shown in FIG. 7, the end 75 may be provided with one or more notches 90 to expose at least a portion of the inner assembly 25 for external welding. The notched end 75 may be spaced apart from the outlet flange 30 so as to define the notch 90 between the outer shell 20, the inner assembly 25, and the outlet flange 30.

The size, location, quantity, and shape of the notches 90 may vary depending on the particular application and other design factors. Some factors may include the materials of construction and thickness of the inner assembly 25, lower portion 60, and/or outlet flange 30. Although the single weld 80 is not shown in FIG. 5, 6, or 7 for clarity purposes, it is understood that the weld 80 may be formed in and around the notch 90 to connect the inner assembly 25, the lower portion 60, and flange 30 to form the welded joint 15. It is also to be understood that the single weld 80 may continue around the perimeter of the end 75 along the flange 30.

Turning to the manifold assembly 10 having a dual-layer to flange welded joint 15, an example of a method of making the manifold assembly 10 as illustrated in FIGS. 1 through 7 is set forth below. The inlet flange 35, tubes 45, and inner assembly 25 are fixtured while the tubes 45 are welded to the inlet flange 35. The lower portion 60 may be fixtured to the inlet flange 35 and/or inner assembly 25 so that the outlet flange 30 is slip fit about the inner assembly 25. As shown in FIG. 3, a predetermined sized gap 70 is left between the end 75 and the outlet flange 30. The dual-layer to flange welded joint 15 is formed, as shown in FIG. 3, by externally welding a single weld 80 along the gap 70 between the outlet flange 30, the end 75, and the inner assembly 25. The upper portion 55 of the outer shell 20 is welded to the lower portion 60 to form overlap joint 65, thereby enclosing the inner assembly 25 therein.

The single weld 80 increases manifold design flexibility and is more cost effective than two welds, particularly since the single weld 80 is an external weld. With only one weld 80 forming the dual-layer to flange welded joint 15, other associated components, processes, and assembly fixtures may be simplified. For example, the outlet flange 30 does not require any expensive counterbores or chamfers, which are common in a typical dual-layer welded flange joint utilizing two welds.

In addition, although the welded joint 15 is only described with respect to the outlet flange 30, it is to be understood that it may also be applied to any flange. For example, the exhaust manifold assembly 10 may include a welded joint 15 as described at the inlet flange 35, or the outlet flange 30, meaning the inlet flange 35 or the outlet flange 30, or both, may include a welded joint 15 as described. Further, it is understood that the dual-layer weld 15 may be used in a variety of applications other than manifolds. Examples include, but not limited to, heat transfer applications such as reactors, boilers, heat exchangers, and insulators.

The invention has been described above and, obviously, modifications and alternations will occur to others upon a reading and understanding of this specification. The claims as follows are intended to include all modifications and alterations insofar as they come within the scope of the claims or the equivalent thereof.

Having thus described the invention, we claim:

1. A dual wall exhaust manifold comprising:

a flange;

an inner assembly having a plurality of runners for transporting engine exhaust gases from an inlet to an outlet of the inner assembly, the outlet or the inlet of the inner assembly being connected to the flange;

an outer shell enclosing the inner assembly and spaced apart from the inner assembly, the outer shell having an end portion;

at least one outwardly facing notch in the outer shell, the notch defined by the flange, the inner assembly, and the outer shell end portion; and a single weld located along the notch to interconnect the flange, the inner assembly and the outer shell.

2. The dual wall exhaust manifold of claim 1 wherein the weld extends along the entire perimeter of the outer shell end portion.

3. The dual wall exhaust manifold of claim 2 wherein the flange includes a bore for receiving the inner assembly.

4. The dual wall exhaust manifold of claim 3 wherein inner assembly is slip fit into the bore, the slip fit allowing for thermal expansion of the inner assembly.

5. The dual wall exhaust manifold of claim 4 wherein the inner assembly is formed from an upper portion and a lower portion.

6. The dual wall exhaust manifold of claim 5 wherein the upper portion and a lower portion are welded together.

7. The dual wall exhaust manifold of claim 4 wherein the outer shell is formed from an upper portion and a lower portion.

8. The dual wall exhaust manifold of claim 1 wherein the notches are equidistantly spaced around the entire perimeter of the outer shell end portion.

9. The dual wall exhaust manifold of claim 8 wherein each notch includes a single weld to interconnect the flange, the inner assembly and the outer shell.

* * * * *